US009458604B2

(12) United States Patent
Zhang et al.

(10) Patent No.: US 9,458,604 B2
(45) Date of Patent: Oct. 4, 2016

(54) HYBRID APPARATUS AND METHOD FOR HYDRAULIC SYSTEMS

(71) Applicant: CATERPILLAR INC., Peoria, IL (US)

(72) Inventors: Jiao Zhang, Naperville, IL (US); Michael Schwab, Crest Hill, IL (US); Pengfei Ma, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 337 days.

(21) Appl. No.: 14/146,994

(22) Filed: Jan. 3, 2014

(65) Prior Publication Data

US 2015/0191897 A1 Jul. 9, 2015

(51) Int. Cl.
*F15B 1/02* (2006.01)
*E02F 9/22* (2006.01)
*F15B 21/14* (2006.01)

(52) U.S. Cl.
CPC ..... *E02F 9/2217* (2013.01); *E02F 9/2292* (2013.01); *E02F 9/2296* (2013.01); *F15B 1/024* (2013.01); *F15B 21/14* (2013.01)

(58) Field of Classification Search
CPC ..... F15B 1/024; F15B 1/033; F15B 21/14
See application file for complete search history.

(56) References Cited

U.S. PATENT DOCUMENTS 2,294,396 A * 9/1942 Feuchter ..... 137/209
6,655,136 B2 * 12/2003 Holt et al. ..... 60/414
7,204,084 B2 4/2007 Ma et al.
7,905,088 B2 * 3/2011 Stephenson et al. ..... 60/414
2010/0236232 A1 9/2010 Boehm et al.
2012/0151904 A1 * 6/2012 Shang et al. ..... 60/327
2013/0098018 A1 4/2013 Knussman

FOREIGN PATENT DOCUMENTS

JP 2004-028233 A 1/2004
JP 2008-115989 A 5/2008
JP 2010-084888 A 4/2010
JP 2010-121726 A 6/2010
JP 2013-036495 A 2/2013
JP 2013-087831 A 5/2013
WO 2013-018271 A1 2/2013
WO 2013-057919 A1 4/2013

* cited by examiner

*Primary Examiner* — F. Daniel Lopez
(74) *Attorney, Agent, or Firm* — Hibshman Claim Contruction PLLC

(57) ABSTRACT

A hydraulic apparatus and a method of operating the hydraulic apparatus are disclosed. The hydraulic apparatus includes a flow control module, a first pump fluidly coupled to the flow control module via a first conduit, a first rotating group fluidly coupled to the flow control module via a second conduit, a first actuator fluidly coupled to the flow control module, a second actuator fluidly coupled to a second pump, a first accumulator, and a controller operatively coupled to the flow control module, the first charge valve, and the discharge valve. The first rotating group is configured to perform a pumping function and a motor function. The first accumulator is in selective fluid communication with the first actuator via a third conduit and a first charge valve, the second actuator via a fourth conduit and the first charge valve, and the first rotating group via a discharge valve.

17 Claims, 6 Drawing Sheets

HYBRID APPARATUS AND METHOD FOR HYDRAULIC SYSTEMS

TECHNICAL FIELD

This patent disclosure relates generally to hydraulic systems and, more particularly, to a hybrid hydraulic system for selectively driving two or more hydraulic actuators.

BACKGROUND

Hydraulic systems are known for converting fluid power, for example, pressurized flow, into mechanical power. Fluid power may be transferred from one or more hydraulic pumps through fluid conduits to one or more hydraulic actuators. Hydraulic actuators may include hydraulic motors that convert fluid power into shaft rotational power, hydraulic cylinders that convert fluid power into translational power, or other hydraulic actuators known in the art.

In an open-loop hydraulic system, fluid discharged from an actuator is directed to a low-pressure reservoir, from which the pump draws fluid. In a closed-loop hydraulic system, a pump is coupled to a hydraulic motor through a motor supply conduit and a pump return conduit, such that all of the hydraulic fluid is not returned to a low-pressure reservoir upon each pass through the closed-loop. Instead, fluid discharged from an actuator in a closed-loop system is directed back to the pump for immediate recirculation.

Japanese Publication No. 2004-028233 (hereinafter "the '233 publication"), entitled "Oil Pressure Energy Recovering/Regenerating Apparatus," purports to describe an oil pressure energy recovering/regenerating apparatus for recovering the energy of a return pressure oil from a hydraulic actuator and regenerating the recovered energy as a drive energy in a drive means. According to the '233 publication a first hydraulic pump motor is coupled to a second hydraulic pump motor via a shaft. Hydraulic fluid discharged from a hydraulic actuator is directed to the first hydraulic pump motor which converts fluid power from the hydraulic fluid into shaft power. Further according to the '233 publication, the second hydraulic pump motor converts the input shaft power into fluid power delivered to an accumulator or to a third hydraulic pump motor coupled to a main driving source by a shaft.

However, the hydraulic system of the '233 publication does not permit charging the accumulator directly from fluid communication with a hydraulic actuator. As a result, the conversion of fluid power to shaft power through the first hydraulic pump motor and the conversion of shaft power into fluid power through the second hydraulic pump motor are each diminished by the respective inefficiencies of the first hydraulic pump motor and the second hydraulic pump motor.

Accordingly, there is a need for an improved hydraulic system to address the problems described above and/or problems posed by other conventional approaches.

SUMMARY

In one aspect, the disclosure describes a hydraulic system. The hydraulic system includes a flow control module, a first pump fluidly coupled to the flow control module via a first conduit, a first rotating group fluidly coupled to the flow control module via a second conduit, a first actuator fluidly coupled to the flow control module, a second actuator fluidly coupled to a second pump, a first accumulator, and a controller. The first rotating group is configured to perform a pumping function and a motor function. The first accumulator is in selective fluid communication with the first actuator via a third conduit and a first charge valve, the second actuator via a fourth conduit and the first charge valve, and the first rotating group via a discharge valve. The controller is operatively coupled to the flow control module, the first charge valve, and the discharge valve, and the controller is configured to selectively effect fluid communication between the first actuator and the first pump via the first conduit, selectively effect fluid communication between the first actuator and the first rotating group via the second conduit, selectively charge the first accumulator by operating the first charge valve, and selectively discharge the first accumulator through the first rotating group by operating the discharge valve.

In yet another aspect, the disclosure describes a method of operating a hydraulic system. The hydraulic system includes a flow control module, a first pump fluidly coupled to the flow control module via a first conduit, a first rotating group fluidly coupled to the flow control module via a second conduit, a first actuator fluidly coupled to the flow control module, a second actuator fluidly coupled to a second pump, and a first accumulator. The first rotating group is configured to perform a pumping function and a motor function. The first accumulator is in selective fluid communication with the first actuator via a third conduit and a first charge valve, the second actuator via a fourth conduit and the first charge valve, and the first rotating group via a discharge valve. The method includes effecting selective fluid communication between the first actuator and the first pump via the first conduit, effecting selective fluid communication between the first actuator and the first rotating group via the second conduit, charging the first accumulator by operating the first charge valve, and discharging the first accumulator through the first rotating group by operating the discharge valve.

DETAILED DESCRIPTION

Figure 1:
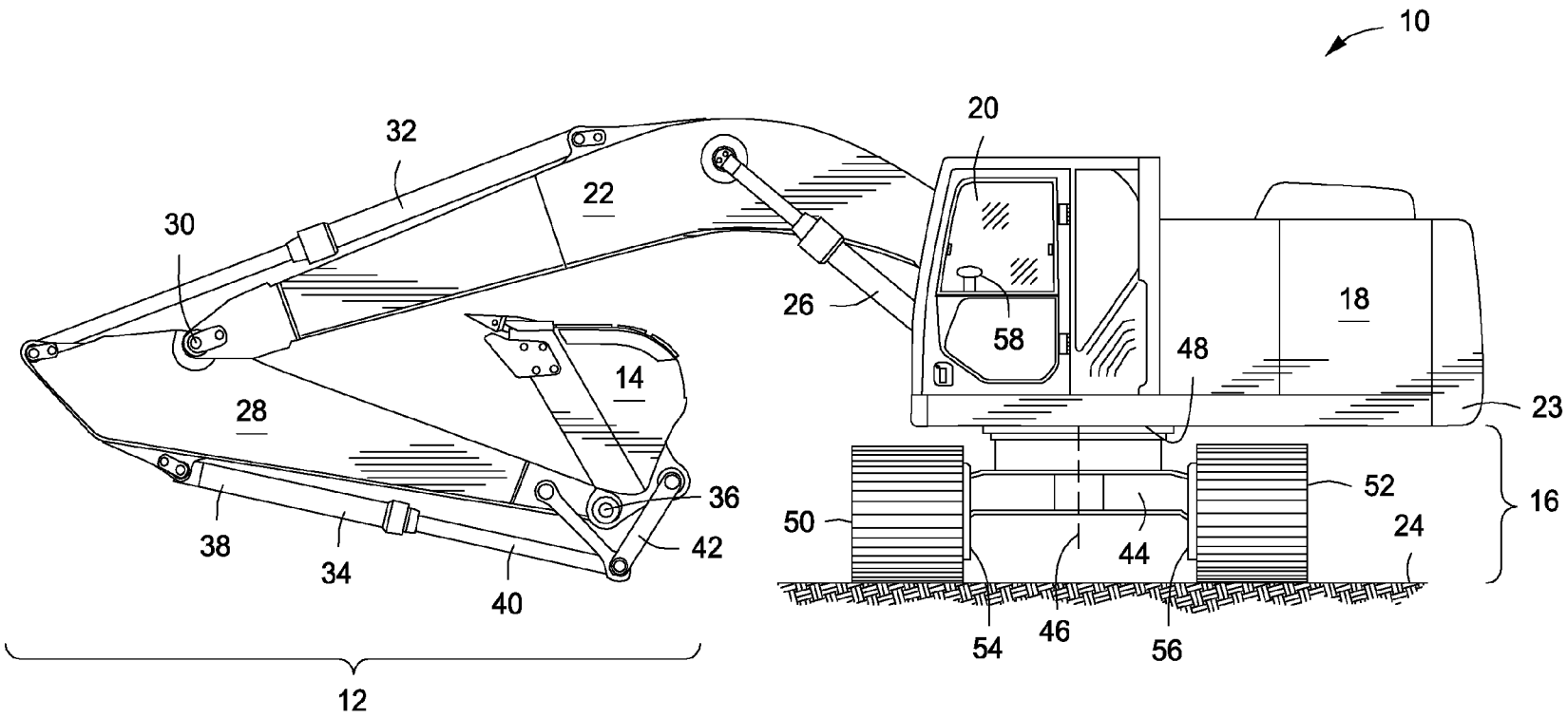
FIG. 1 illustrates an exemplary machine, according to an aspect of the disclosure.

FIG. 1 illustrates an exemplary machine 10 having various systems and components that cooperate to accomplish a task. The machine 10 may embody a fixed or mobile machine that performs some type of operation associated with an industry such as mining, construction, farming, transportation, or another industry known in the art. For example, the machine 10 may be an earth moving machine such as a shovel or an excavator (shown in FIG. 1), a dozer, a loader, a backhoe, a motor grader, a dump truck, or another earth moving machine. The machine 10 may include an implement system 12 configured to move a work tool 14, a drive system 16 for propelling the machine 10, a power source 18 or other prime mover that provides power to the implement system 12 and the drive system 16, and an operator station 20 that may include control interfaces for manual control of the implement system 12, the drive system 16, and/or the power source 18.

The implement system 12 may include a linkage structure coupled to hydraulic actuators, which may include linear or rotary actuators, to move the work tool 14. For example, the implement system 12 may include a boom 22 that is pivotally coupled to a body 23 of the machine 10 about a first horizontal axis (not shown) with respect to the work surface 24, and actuated by one or more double-acting, boom hydraulic cylinders 26 (only one shown in FIG. 1). The implement system 12 may also include a stick 28 that is pivotally coupled to the boom 22 about a second horizontal axis 30 with respect to the work surface 24, and actuated by a double-acting, stick hydraulic cylinder 32.

The implement system 12 may further include a double-acting, tool hydraulic cylinder 34 that is operatively coupled between the stick 28 and the work tool 14 to pivot the work tool 14 about a third horizontal axis 36. In the non-limiting aspect illustrated in FIG. 1, a head-end 38 of the tool hydraulic cylinder 34 is connected to a portion of the stick 28, and an opposing rod-end 40 of the tool hydraulic cylinder 34 is connected to the work tool 14 by way of a power link 42. The body 23 may be connected to an undercarriage 44 to swing about a vertical axis 46 by a hydraulic swing motor 48. According to an aspect of the disclosure, the swing motor 48 may include a first swing motor and a second swing motor.

Numerous different work tools 14 may be attached to a single machine 10 and controlled by an operator. The work tool 14 may include any device used to perform a particular task such as, for example, a bucket (shown in FIG. 1), a fork arrangement, a blade, a shovel, a ripper, a dump bed, a broom, a snow blower, a propelling device, a cutting device, a grasping device, or any other task-performing device known in the art. Although the aspect illustrated in FIG. 1 shows the work tool 14 configured to pivot in the vertical direction relative to the body 23 and to swing in the horizontal direction about the pivot axis 46, it will be appreciated that the work tool 14 may alternatively or additionally rotate relative to the stick 28, slide, open and close, or move in any other manner known in the art.

The drive system 16 may include one or more traction devices powered to propel the machine 10. As illustrated in FIG. 1, the drive system 16 may include a left track 50 located on one side of the machine 10, and a right track 52 located on an opposing side of the machine 10. The left track 50 may be driven by a left travel motor 54, and the right track 52 may be driven by a right travel motor 56. It is contemplated that the drive system 16 could alternatively include traction devices other than tracks, such as wheels, belts, or other known fraction devices. The machine 10 may be steered by generating a speed and/or rotational direction difference between the left travel motor 54 and the right travel motor 56, while straight travel may be effected by generating substantially equal output speeds and rotational directions of the left travel motor 54 and the right travel motor 56.

The power source 18 may include a combustion engine such as, for example, a reciprocating compression ignition engine, a reciprocating spark ignition engine, a combustion turbine, or another type of combustion engine known in the art. It is contemplated that the power source 18 may alternatively include a non-combustion source of power such as a fuel cell, a power storage device, or another power source known in the art. The power source 18 may produce a mechanical or electrical power output that may then be converted to hydraulic power for moving the actuators of the implement system 12.

The operator station 20 may include devices that receive input from an operator indicative of desired maneuvering. Specifically, the operator station 20 may include one or more operator interface devices 58, for example a joystick (shown in FIG. 1), a steering wheel, or a pedal, that are located near an operator seat (not shown). Operator interface devices may initiate movement of the machine 10, for example travel and/or tool movement, by producing displacement signals that are indicative of desired machine 10 maneuvering. As an operator moves interface device 58, the operator may affect a corresponding machine 10 movement in a desired direction, with a desired speed, and/or with a desired force.

Figure 2:
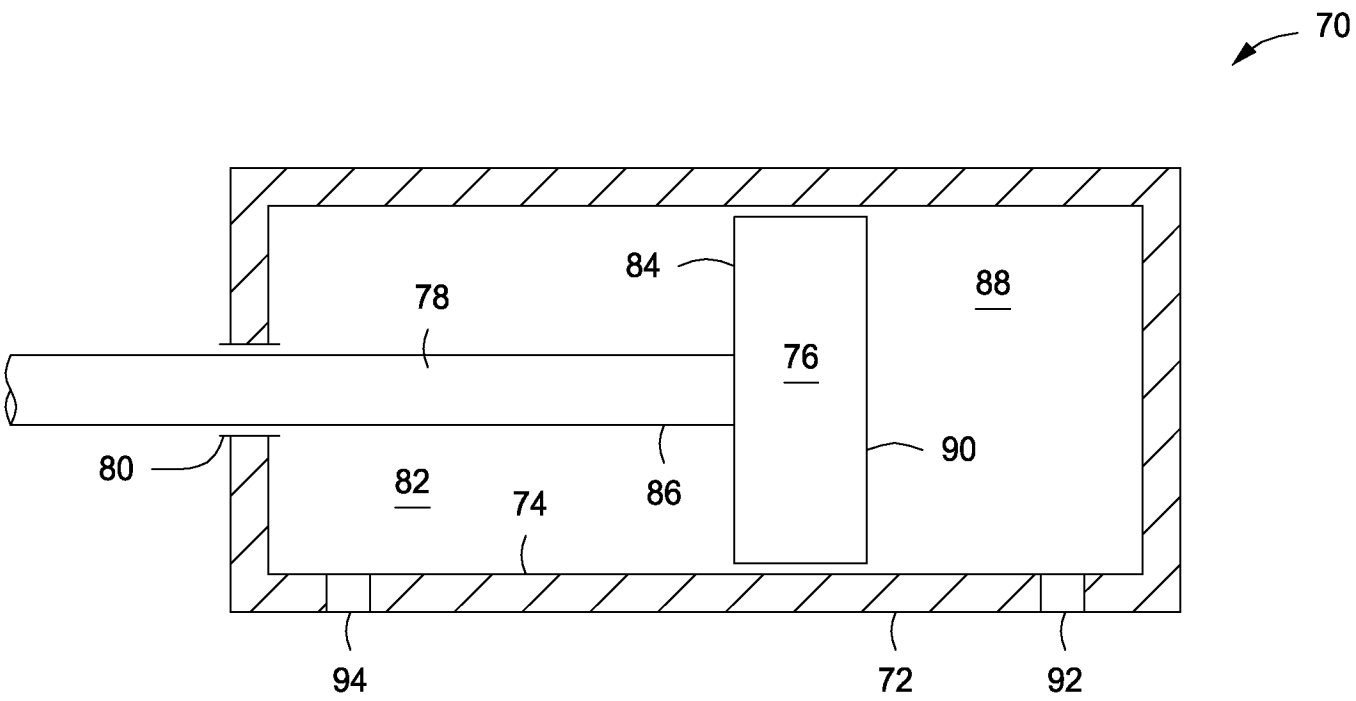
FIG. 2 shows a schematic view of a linear hydraulic cylinder, according to an aspect of the disclosure.

FIG. 2 shows a schematic view of a linear hydraulic cylinder 70, according to an aspect of the disclosure. The linear hydraulic cylinder 70 may include a tube 72 defining a cylinder bore 74 therein, and a piston assembly 76 disposed within the cylinder bore 74. A rod 78 is coupled to the piston assembly 76 and extends through the tube 72 at a seal 80. A rod-end chamber 82 is defined by a first face 84 of the piston, the cylinder bore 74, and a surface 86 of the rod 78. A head-end chamber 88 is defined by a second face 90 of the piston and the cylinder bore 74.

The head-end chamber 88 and the rod-end chamber 82 of the linear hydraulic actuator 70 may be selectively supplied with pressurized fluid or drained of fluid via the head-end port 92 and the rod-end port 94, respectively, to cause piston assembly 76 to translate within tube 72, thereby changing the effective length of the actuator to move work tool 14, for example. A flow rate of fluid into and out of the head-end chamber 88 and the rod-end chamber 82 may relate to a translational velocity of the actuator, while a pressure differential and/or an area differential between the head-end chamber 88 and the rod-end chamber 82 may relate to a force imparted by the actuator on the work tool 14. It will be appreciated that any of the boom hydraulic cylinders 26, the stick hydraulic cylinder 32, or the tool hydraulic cylinder 34, shown in FIG. 1, may embody structural features of the linear hydraulic actuator 70 illustrated in FIG. 2.

A rotary actuator may include first and second chambers located to either side of a fluid work-extracting mechanism such as an impeller, plunger, or series of pistons. When the first chamber is filled with pressurized fluid and the second chamber is simultaneously drained of fluid, the fluid work-extracting mechanism may be urged to rotate in a first direction by a pressure differential across the first and second chambers of the rotary actuator. Conversely, when the first chamber is drained of fluid and the second chamber is simultaneously filled with pressurized fluid, the fluid work-extracting mechanism may be urged to rotate in an opposite direction by the pressure differential. The flow rate of fluid into and out of the first and second chambers may be determined by a rotational velocity of the actuator, while a magnitude of the pressure differential across the pumping mechanism may determine an output torque. It will be appreciated that any of the hydraulic swing motor 48, the left travel motor 54, or the right travel motor 56, illustrated in FIG. 1, may embody the rotary actuator structure described above. Further, it will be appreciated that rotary actuators may have a fixed displacement or a variable displacement, as desired.

Figure 3A:
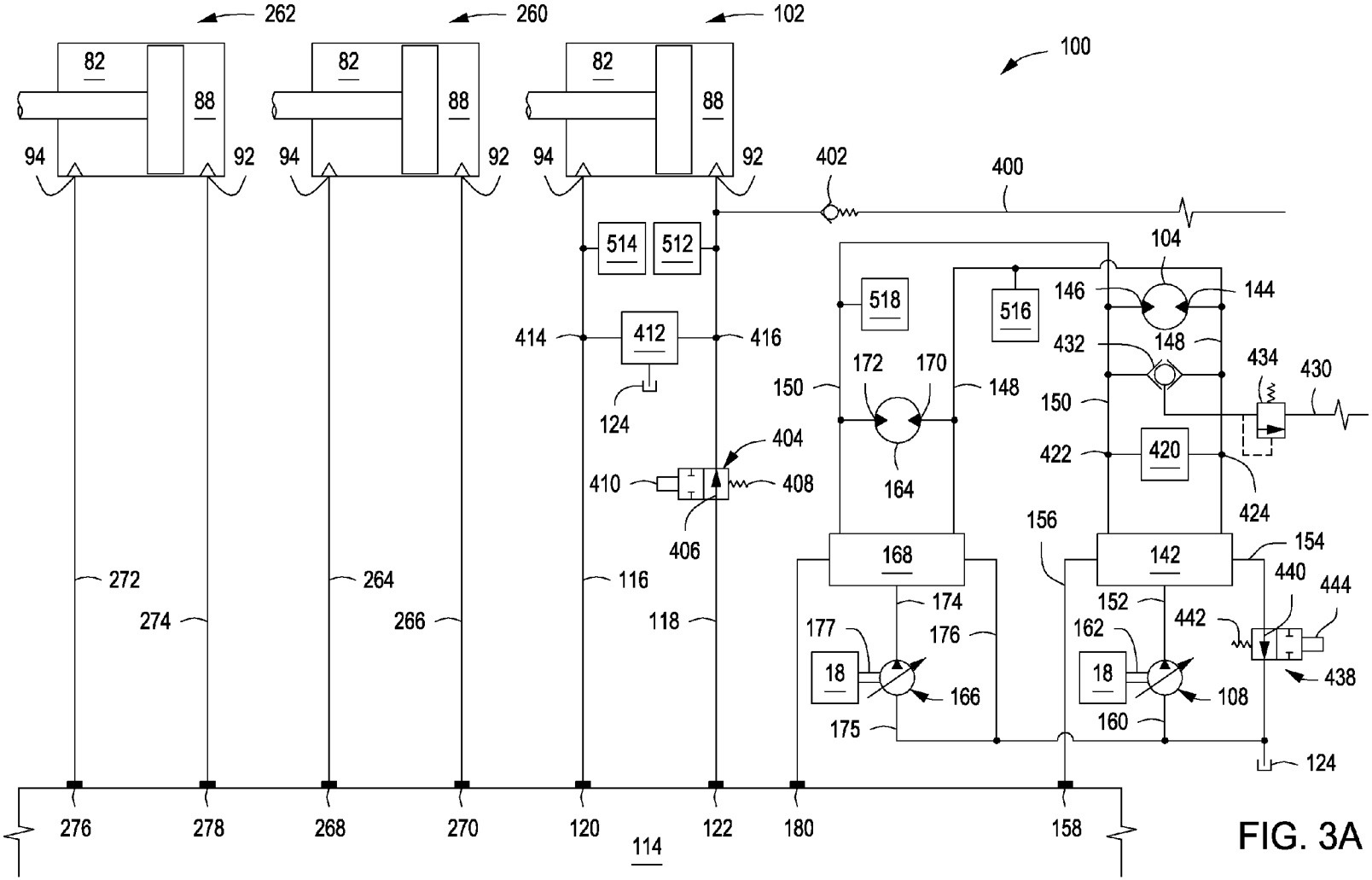
FIGS. 3A-C show a schematic view of a hydraulic system, according to an aspect of the disclosure.
Figure 3B:
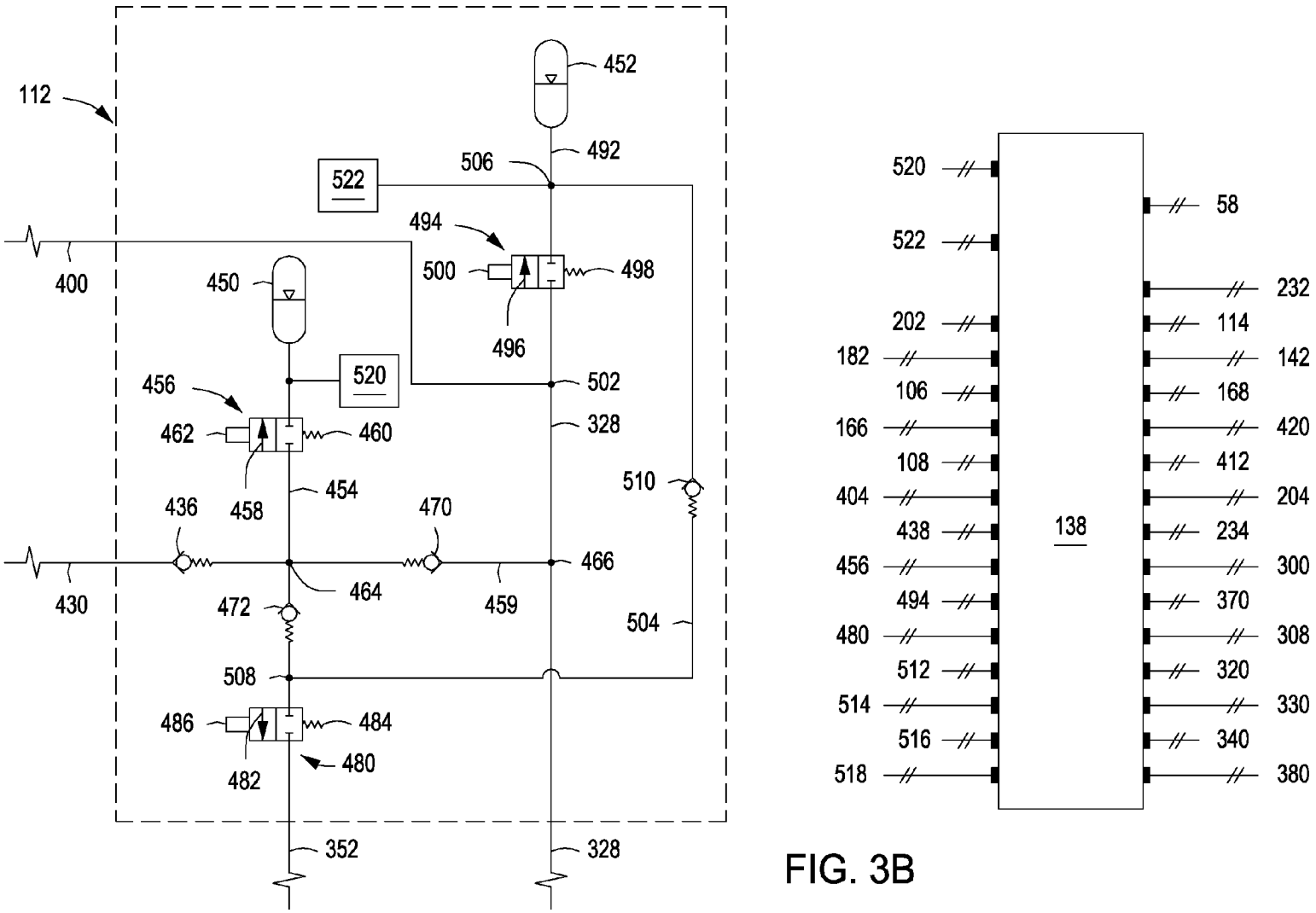
Figure 3C:
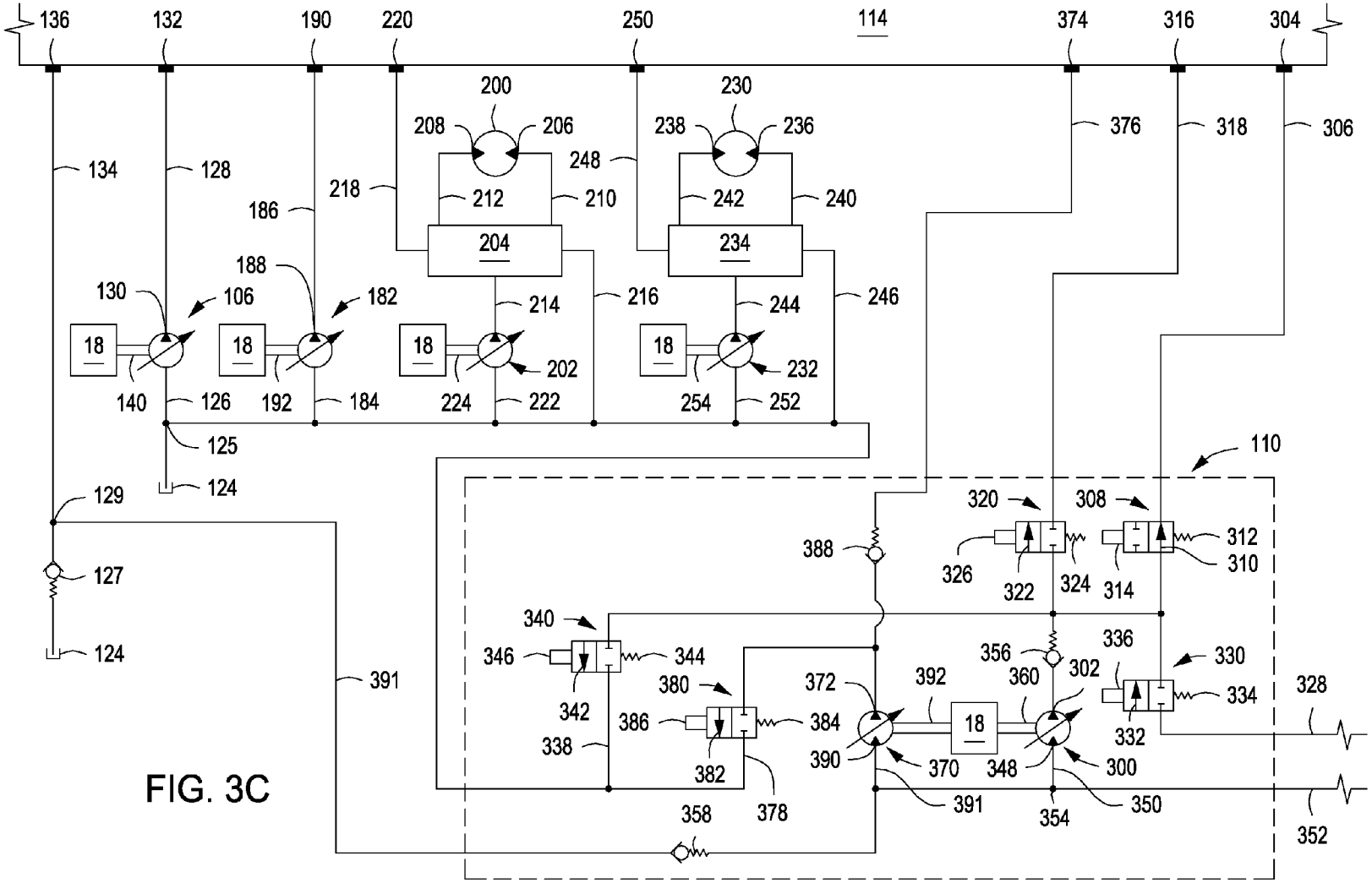

FIGS. 3A-C (collectively "FIG. 3") show a hydraulic system 100, according to an aspect of the disclosure. The hydraulic system 100 includes a first actuator 102, a second actuator 104, a first pump 106, a second pump 108, an auxiliary pump/motor system 110, and an accumulator system 112.

Referring to FIG. 3A, the first actuator 102 may embody the structure of the linear hydraulic actuator 70 illustrated in FIG. 2. Thus, the first actuator 102 may have a head-end chamber 88, a rod-end chamber 82, a head-end port 92, and a rod-end port 94. It will be appreciated that the first actuator 102 may be a boom hydraulic cylinder 26, a stick hydraulic cylinder 32, or a tool hydraulic cylinder 34 of the machine 10, as shown in FIG. 1, or serve any other hydraulic cylinder function known in the art. According to an aspect of the disclosure, the first actuator 102 is a boom hydraulic cylinder 26 of the machine 10 (see FIG. 1).

The first actuator 102 is fluidly coupled to a flow control module 114 via a conduit 116 and a conduit 118. The conduit 116 may effect fluid communication between the rod-end port 94 of the first actuator 102 and the port 120 of the flow control module 114, and the conduit 118 may effect fluid communication between the head-end port 92 of the first actuator 102 and the port 122 of the flow control module 114.

Referring to FIG. 3C, the first pump 106 may draw fluid from a reservoir 124 via a conduit 126 and discharge the fluid to a conduit 128 via a first pump outlet 130. The conduit 128 effects fluid communication between the first pump 106 and the flow control module 114 via a port 132. The flow control module 114 may be in fluid communication with the reservoir 124 via a conduit 134 coupled to a port 136 of the flow control module 114. Further, the conduit 134 may be in series fluid communication with a check valve 127, which is arranged to allow flow therethrough in a direction toward the reservoir 124, and block flow therethrough in a direction away from the reservoir 124. The check valve 127 may include a resilient member that sets a finite opening pressure for the check valve 127 above a pressure of the reservoir 124. The reservoir 124 may be in fluid communication with an ambient environment of the machine 10, for example, through a vent or the like.

Figure 4:
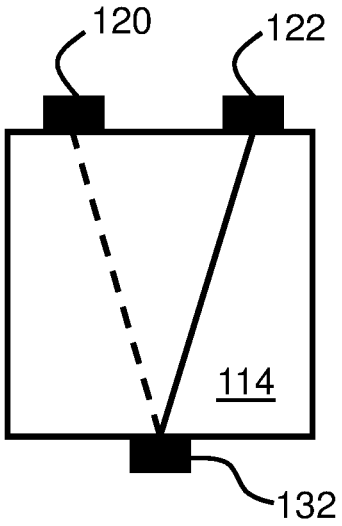
FIG. 4 shows a schematic view of a flow control module, according to an aspect of the disclosure.

According to an aspect of the disclosure, the flow control module 114 is configured to selectively effect fluid communication between the port 132 and the port 122 (see e.g., FIG. 4, solid line), and effect fluid communication between the port 120 and the port 136, while blocking fluid communication between the port 132 and the port 120, and blocking fluid communication between the port 136 and the port 122 via the flow control module 114. Accordingly, the flow control module 114 may selectively effect fluid communication between the first pump 106 and the head-end chamber 88 of the first actuator 102, and effect fluid communication between the rod-end chamber 82 of the first actuator 102 and the reservoir 124 via an open-loop circuit.

According to another aspect of the disclosure, the flow control module 114 is configured to selectively effect fluid communication between the port 132 and the port 120 (see e.g., FIG. 4, dashed line), and effect fluid communication between the port 136 and the port 122, while blocking fluid communication between the port 136 and the port 120, and blocking fluid communication between the port 132 and the port 122. Accordingly, the flow control module 114 may selectively effect fluid communication between the first pump 106 and the rod-end chamber 82 of the first actuator 102, and effect fluid communication between the head-end chamber 88 of the first actuator 102 and the reservoir 124 via an open-loop circuit.

The first pump 106 may have variable displacement, which is controlled via a controller 138 to draw fluid from the reservoir 124 and discharge the fluid at a specified elevated pressure to the conduit 128. The first pump 106 may include a stroke-adjusting mechanism, for example a swashplate, a position of which is hydro-mechanically adjusted based on, among other things, a desired speed of the actuators, to thereby vary an output (e.g., a discharge flow rate) of the first pump 106. It is contemplated that the first pump 106 may be coupled to the power source 18 in tandem (e.g., via the same shaft) or in parallel (e.g., via a gear train) with other pumps of the machine 10, as desired. Further, the displacement of the first pump 106 may be adjusted from a zero displacement position at which substantially no fluid is discharged from first pump 106, to a maximum displacement position at which fluid is discharged from first pump 106 at a maximum rate into the conduit 128.

The first pump 106 may be directly or indirectly coupled to the power source 18 via a shaft 140. Indirect coupling between the shaft 140 of the first pump 106 and the power source 18 may include a torque converter, a gear box, an electrical circuit, or other coupling method known in the art.

Referring to FIG. 3A, the second actuator 104 may be a rotary actuator as described above. Thus, the second actuator 104 may be the hydraulic swing motor 48, the left travel motor 54, or the right travel motor 56 of the machine 10, as illustrated in FIG. 1, or serve any other hydraulic motor function known in the art. According to an aspect of the disclosure, the second actuator 104 is the hydraulic swing motor 48. According to another aspect of the disclosure, the second actuator 104 is a first swing motor of the hydraulic swing motor 48.

The second actuator 104 is fluidly coupled to the second pump 108 via a first diverter valve assembly 142. A first port 144 and a second port 146 of the second actuator 104 are in fluid communication with the first diverter valve assembly 142 via a conduit 148 and a conduit 150, respectively. Further, the first diverter valve assembly 142 is in fluid communication with the second pump 108 and the reservoir 124 via the conduit 152 the conduit 154, respectively.

According to an aspect of the disclosure, the first diverter valve assembly 142 is configured to selectively effect fluid communication between the second pump 108 and the second actuator 104 via the conduit 148, and selectively effect fluid communication between the reservoir 124 and the conduit 150, while blocking fluid communication between the second pump 108 and the conduit 150, and blocking fluid communication between the reservoir 124 and the conduit 148. According to another aspect of the disclosure, the first diverter valve assembly 142 is configured to selectively effect fluid communication between the second pump 108 and the second actuator 104 via the conduit 150, and selectively effect fluid communication between the reservoir 124 and the conduit 148, while blocking fluid communication between the second pump 108 and the conduit 148, and blocking fluid communication between the reservoir 124 and the conduit 150.

According to yet another aspect of the disclosure, the first diverter valve assembly 142 is configured to substantially block fluid communication between the second pump 108 and the second actuator 104 via the conduit 148 and the conduit 150, and selectively effect fluid communication between the second pump 108 and the flow control module 114 via conduit 156 and port 158 of the flow control module 114. Further, the first diverter valve assembly 142 may be configured to block fluid communication between the second pump 108 and the flow control module 114 via the conduit 156 while effecting fluid communication between the second pump 108 and the second actuator 104. Alternatively, it will be appreciated that the first diverter valve assembly 142 may be configured to effect simultaneous fluid communication between the second pump 108 and both the second actuator 104 and the flow control module 114.

The second pump 108 may draw hydraulic fluid from the reservoir 124 via a conduit 160. Further, the second pump 108 may have variable displacement, which is controlled by the controller 138 to discharge the fluid at a specified elevated pressure to the first diverter valve assembly 142. The second pump 108 may include a stroke-adjusting mechanism, for example a swashplate, a position of which is hydro-mechanically adjusted based on, among other things, a desired speed of the actuators, to thereby vary an output (e.g., a discharge flow rate) of the second pump 108. It is contemplated that the second pump 108 may be coupled to the power source 18 in tandem (e.g., via the same shaft) or in parallel (e.g., via a gear train) with other pumps of the machine 10, as desired. Further, the displacement of the second pump 108 may be adjusted from a zero displacement position at which substantially no fluid is discharged from second pump 108, to a maximum displacement position at which fluid is discharged from second pump 108 at a maximum rate into the conduit 152.

The second pump 108 may be directly or indirectly coupled to the power source 18 via a shaft 162. Indirect coupling between the shaft 162 of the second pump 108 and the power source 18 may include a torque converter, a gear box, an electrical circuit, or other coupling method known in the art.

Referring still to FIG. 3A, the hydraulic system 100 may further include a third actuator 164 that is fluidly coupled to a third pump 166 via a second diverter valve assembly 168. A first port 170 and a second port 172 of the third actuator 164 may be in fluid communication with the second diverter valve assembly 168 via the conduit 148 and the conduit 150, respectively. Further, the second diverter valve assembly 168 is in fluid communication with the third pump 166 and the reservoir 124 via the conduit 174 and the conduit 176, respectively. Although the third actuator 164 is shown in FIG. 3 having parallel fluid connection with the second actuator 104 via the conduit 148 and the conduit 150, it will be appreciated that the hydraulic system 100 may be alternately configured such that the third actuator 164 is not in direct fluid communication with the first diverter valve assembly 142.

According to an aspect of the disclosure, the second diverter valve assembly 168 is configured to selectively effect fluid communication between the third pump 166 and the third actuator 164 via the conduit 148, and selectively effect fluid communication between the reservoir 124 and the conduit 150, while blocking fluid communication between the third pump 166 and the conduit 150, and blocking fluid communication between the reservoir 124 and the conduit 148. According to another aspect of the disclosure, the second diverter valve assembly 168 is configured to selectively effect fluid communication between the third pump 166 and the third actuator 164 via the conduit 150, and selectively effect fluid communication between the reservoir 124 and the conduit 148, while blocking fluid communication between the third pump 166 and the conduit 148, and blocking fluid communication between the reservoir 124 and the conduit 150.

According to yet another aspect of the disclosure, the second diverter valve assembly 168 is configured to substantially block fluid communication between the third pump 166 and the third actuator 164 via the conduit 148 and the conduit 150, and selectively effect fluid communication between the third pump 166 and the flow control module 114 via a conduit 178 and a port 180 of the flow control module 114. Further, the second diverter valve assembly 168 may be configured to block fluid communication between the third pump 166 and the flow control module 114 via the conduit 178 while effecting fluid communication between the third pump 166 and the third actuator 164. Alternatively, it will be appreciated that the second diverter valve assembly 168 may be configured to effect simultaneous fluid communication between the third pump 166 and both the third actuator 164 and the flow control module 114.

The third actuator 164 may be a rotary actuator as described above. Thus, the third actuator 164 may be the hydraulic swing motor 48, the left travel motor 54, or the right travel motor 56 of the machine 10, as illustrated in FIG. 1, or serve any other hydraulic motor function known in the art. According to an aspect of the disclosure, the third actuator 164 is the hydraulic swing motor 48. According to another aspect of the disclosure, the third actuator 164 is a second swing motor of the hydraulic swing motor 48.

The third pump 166 may draw hydraulic fluid from the reservoir 124 via a conduit 175. Further, the third pump 166 may have variable displacement, which is controlled by the controller 138 to discharge the fluid at a specified elevated pressure to the second diverter valve assembly 168. The third pump 166 may include a stroke-adjusting mechanism, for example a swashplate, a position of which is hydro-mechanically adjusted based on, among other things, a desired speed of the actuators, to thereby vary an output (e.g., a discharge flow rate) of the third pump 166. It is contemplated that the third pump 166 may be coupled to the power source 18 in tandem (e.g., via the same shaft) or in parallel (e.g., via a gear train) with other pumps of the machine 10, as desired. Further, the displacement of the third pump 166 may be adjusted from a zero displacement position at which substantially no fluid is discharged from third pump 166, to a maximum displacement position at which fluid is discharged from third pump 166 at a maximum rate into the conduit 174.

The third pump 166 may be directly or indirectly coupled to the power source 18 via a shaft 177. Indirect coupling between the shaft 177 of the third pump 166 and the power source 18 may include a torque converter, a gear box, an electrical circuit, or other coupling method known in the art.

Referring to FIG. 3C, the hydraulic system 100 may further include a fourth pump 182 that draws fluid from the reservoir 124 via a conduit 184 and a node 125 and discharges the fluid to a conduit 186 via a fourth pump outlet 188. The conduit 186 effects fluid communication between the fourth pump 182 and the flow control module 114 via a port 190.

The fourth pump 182 may have variable displacement, which is controlled by the controller 138 to draw fluid from the reservoir 124 and discharge the fluid at a specified elevated pressure to the conduit 186. The fourth pump 182 may include a stroke-adjusting mechanism, for example a swashplate, a position of which is hydro-mechanically adjusted based on, among other things, a desired speed of the actuators, to thereby vary an output (e.g., a discharge flow rate) of the fourth pump 182. It is contemplated that the fourth pump 182 may be coupled to the power source 18 in tandem (e.g., via the same shaft) or in parallel (e.g., via a gear train) with other pumps of the machine 10, as desired. Further, the displacement of the fourth pump 182 may be adjusted from a zero displacement position at which substantially no fluid is discharged from fourth pump 182, to a maximum displacement position at which fluid is discharged from fourth pump 182 at a maximum rate into the conduit 186.

The fourth pump 182 may be directly or indirectly coupled to the power source 18 via a shaft 192. Indirect coupling between the shaft 192 of the fourth pump 182 and the power source 18 may include a torque converter, a gear box, an electrical circuit, or other coupling method known in the art.

The hydraulic system 100 may further include a fourth actuator 200 that is fluidly coupled to a fifth pump 202 via a third diverter valve assembly 204. A first port 206 and a second port 208 of the fourth actuator 200 may be in fluid communication with the third diverter valve assembly 204 via the conduit 210 and a conduit 212, respectively. Further, the third diverter valve assembly 204 is in fluid communication with the fifth pump 202 and the reservoir 124 via the conduit 214 and the conduit 216, respectively.

According to an aspect of the disclosure, the third diverter valve assembly 204 is configured to selectively effect fluid communication between the fifth pump 202 and the fourth actuator 200 via the conduit 210, and selectively effect fluid communication between the reservoir 124 and the conduit 212, while blocking fluid communication between the fifth pump 202 and the conduit 212, and blocking fluid communication between the reservoir 124 and the conduit 210. According to another aspect of the disclosure, the third diverter valve assembly 204 is configured to selectively effect fluid communication between the fifth pump 202 and the fourth actuator 200 via the conduit 212, and selectively effect fluid communication between the reservoir 124 and the conduit 210, while blocking fluid communication between the fifth pump 202 and the conduit 210 and blocking fluid communication between the reservoir 124 and the conduit 212.

According to yet another aspect of the disclosure, the third diverter valve assembly 204 is configured to substantially block fluid communication between the fifth pump 202 and the fourth actuator 200 via the conduit 210 and the conduit 212, and selectively effect fluid communication between the fifth pump 202 and the flow control module 114 via conduit 218 and port 220 of the flow control module 114. Further, the third diverter valve assembly 204 may be configured to block fluid communication between the fifth pump 202 and the flow control module 114 via the conduit 218 while effecting fluid communication between the fifth pump 202 and the fourth actuator 200. Alternatively, it will be appreciated that the third diverter valve assembly 204 may be configured to effect simultaneous fluid communication between the fifth pump 202 and both the fourth actuator 200 and the flow control module 114.

The fourth actuator 200 may be a rotary actuator as described above. Thus, the fourth actuator 200 may be the hydraulic swing motor 48, the left travel motor 54, or the right travel motor 56 of the machine 10, as illustrated in FIG. 1, or serve any other hydraulic motor function known in the art. According to an aspect of the disclosure, the fourth actuator 200 is the left travel motor 54.

Referring still to FIG. 3C, the fifth pump 202 may draw hydraulic fluid from the reservoir 124 via a conduit 222 and the node 125. Further, the fifth pump 202 may have variable displacement, which is controlled by the controller 138 to discharge the fluid at a specified elevated pressure to the third diverter valve assembly 204. The fifth pump 202 may include a stroke-adjusting mechanism, for example a swash-plate, a position of which is hydro-mechanically adjusted based on, among other things, a desired speed of the actuators, to thereby vary an output (e.g., a discharge flow rate) of the fifth pump 202. It is contemplated that the fifth pump 202 may be coupled to the power source 18 in tandem (e.g., via the same shaft) or in parallel (e.g., via a gear train) with other pumps of the machine 10, as desired. Further, the displacement of the fifth pump 202 may be adjusted from a zero displacement position at which substantially no fluid is discharged from fifth pump 202, to a maximum displacement position at which fluid is discharged from fifth pump 202 at a maximum rate into the conduit 214.

The fifth pump 202 may be directly or indirectly coupled to the power source 18 via a shaft 224. Indirect coupling between the shaft 224 of the fifth pump 202 and the power source 18 may include a torque converter, a gear box, an electrical circuit, or other coupling method known in the art.

The hydraulic system 100 may further include a fifth actuator 230 that is fluidly coupled to a sixth pump 232 via a fourth diverter valve assembly 234. A first port 236 and a second port 238 of the fifth actuator 230 may be in fluid communication with the fourth diverter valve assembly 234 via the conduit 240 and a conduit 242, respectively. Further, the fourth diverter valve assembly 234 is in fluid communication with the sixth pump 232 and the reservoir 124 via the conduit 244 and the conduit 246, respectively.

According to an aspect of the disclosure, the fourth diverter valve assembly 234 is configured to selectively effect fluid communication between the sixth pump 232 and the fifth actuator 230 via the conduit 240, and selectively effect fluid communication between the reservoir 124 and the conduit 242, while blocking fluid communication between the sixth pump 232 and the conduit 242 and blocking fluid communication between the reservoir 124 and the conduit 240. According to another aspect of the disclosure, the fourth diverter valve assembly 234 is configured to selectively effect fluid communication between the sixth pump 232 and the fifth actuator 230 via the conduit 242, and selectively effect fluid communication between the reservoir 124 and the conduit 240, while blocking fluid communication between the sixth pump 232 and the conduit 240 and blocking fluid communication between the reservoir 124 and the conduit 242.

According to yet another aspect of the disclosure, the fourth diverter valve assembly 234 is configured to substantially block fluid communication between the sixth pump 232 and the fifth actuator 230 via the conduit 240 and the conduit 242, and selectively effect fluid communication between the sixth pump 232 and the flow control module 114 via conduit 248 and port 250 of the flow control module 114. Further, the fourth diverter valve assembly 234 may be configured to block fluid communication between the sixth pump 232 and the flow control module 114 via the conduit 248 while effecting fluid communication between the sixth pump 232 and the fifth actuator 230. Alternatively, it will be appreciated that the fourth diverter valve assembly 234 may be configured to effect simultaneous fluid communication between the sixth pump 232 and both the fifth actuator 230 and the flow control module 114.

The fifth actuator 230 may be a rotary actuator as described above. Thus, the fifth actuator 230 may be the hydraulic swing motor 48, the left travel motor 54, or the right travel motor 56 of the machine 10, as illustrated in FIG. 1, or serve any other hydraulic motor function known in the art. According to an aspect of the disclosure, the fifth actuator 230 is the right travel motor 56.

Referring still to FIG. 3C, the sixth pump 232 may draw hydraulic fluid from the reservoir 124 via a conduit 252 and the node 125. Further, the sixth pump 232 may have variable displacement, which is controlled by the controller 138 to discharge the fluid at a specified elevated pressure to the fourth diverter valve assembly 234. The sixth pump 232 may include a stroke-adjusting mechanism, for example a swash-plate, a position of which is hydro-mechanically adjusted based on, among other things, a desired speed of the actuators, to thereby vary an output (e.g., a discharge flow rate) of the sixth pump 232. It is contemplated that the sixth pump 232 may be coupled to the power source 18 in tandem (e.g., via the same shaft) or in parallel (e.g., via a gear train) with other pumps of the machine 10, as desired. Further, the displacement of the sixth pump 232 may be adjusted from a zero displacement position at which substantially no fluid is discharged from sixth pump 232, to a maximum displacement position at which fluid is discharged from sixth pump 232 at a maximum rate into the conduit 244.

The sixth pump 232 may be directly or indirectly coupled to the power source 18 via a shaft 254. Indirect coupling between the shaft 254 of the sixth pump 232 and the power source 18 may include a torque converter, a gear box, an electrical circuit, or other coupling method known in the art.

Referring to FIG. 3A, the hydraulic system 100 may further include a sixth actuator 260 and a seventh actuator 262. The sixth actuator 260 may embody the structure of the linear hydraulic actuator 70 illustrated in FIG. 2. Thus, the sixth actuator 260 may have a head-end chamber 88, a rod-end chamber 82, a head-end port 92, and a rod-end port 94. It will be appreciated that the sixth actuator 260 may be a boom hydraulic cylinder 26, a stick hydraulic cylinder 32, or a tool hydraulic cylinder 34 of the machine 10, as shown in FIG. 1, or serve any other hydraulic cylinder function known in the art. According to an aspect of the disclosure, the sixth actuator 260 is the stick hydraulic cylinder 32 of the machine 10 (see FIG. 1).

The sixth actuator 260 is fluidly coupled to the flow control module 114 via a conduit 264 and a conduit 266. The conduit 264 may effect fluid communication between the rod-end port 94 of the sixth actuator 260 and the port 268 of the flow control module 114, and the conduit 266 may effect fluid communication between the head-end port 92 of the sixth actuator 260 and the port 270 of the flow control module 114.

The seventh actuator 262 may embody the structure of the linear hydraulic actuator 70 illustrated in FIG. 2. Thus, the seventh actuator 262 may have a head-end chamber 88, a rod-end chamber 82, a head-end port 92, and a rod-end port 94. It will be appreciated that the seventh actuator 262 may be a boom hydraulic cylinder 26, a stick hydraulic cylinder 32, or a tool hydraulic cylinder 34 of the machine 10, as shown in FIG. 1, or serve any other hydraulic cylinder function known in the art. According to an aspect of the disclosure, the seventh actuator 262 is the tool hydraulic cylinder 34 of the machine 10 (see FIG. 1). According to another aspect of the disclosure, the tool 14 of the machine 10 is a bucket.

The seventh actuator 262 is fluidly coupled to the flow control module 114 via a conduit 272 and a conduit 274. The conduit 272 may effect fluid communication between the rod-end port 94 of the seventh actuator 262 and the port 276 of the flow control module 114, and the conduit 274 may effect fluid communication between the head-end port 92 of the seventh actuator 262 and the port 278 of the flow control module 114.

Referring to FIG. 3C, the auxiliary pump/motor system 110 includes a first rotating group 300 having a first port 302 in fluid communication with a port 304 of the flow control module 114 via a conduit 306. The conduit 306 may be in series fluid communication with a first auxiliary valve 308, which may effect selective fluid communication between the first port 302 of the first rotating group 300 and the port 304 of the flow control module 114.

When configured in a first position, the first auxiliary valve 308 may effect fluid communication between the first port 302 of the first rotating group 300 and the port 304 of the flow control module 114 via the flow passage 310. When configured in a second position, the first auxiliary valve 308 may block fluid communication between the first port 302 of the first rotating group 300 and the port 304 of the flow control module 114 via the first auxiliary valve 308.

The first auxiliary valve 308 may include a resilient element 312 that biases the configuration of the first auxiliary valve 308 toward the first position. The first auxiliary valve 308 may further include an actuator 314 that acts to bias the configuration of the first auxiliary valve 308 toward the second position, against the resilient element 312. Alternatively, the actuator 314 may be double-acting, and therefore capable of biasing the configuration of the first auxiliary valve 308 toward either its first position or its second position.

The actuator 314 may be a hydraulic actuator, a pneumatic actuator, a solenoid actuator, or any other type of actuator known to persons having skill in the art. The actuator 314 may cause the configuration of the first auxiliary valve 308 to toggle between its first position and its second position. Alternatively, actuator 314 may actuate the configuration of the first auxiliary valve 308 across a spectrum of throttle positions proportional to a control signal applied to the actuator 314. It will be appreciated that the actuator 314 may be operatively coupled to the controller 138 and may be actuated by control signals transmitted therefrom.

The first port 302 of the first rotating group 300 may also be in fluid communication with a port 316 of the flow control module 114 via a conduit 318. The conduit 318 may be in series fluid communication with a second auxiliary valve 320, which may effect selective fluid communication between the first port 302 of the first rotating group 300 and the port 316 of the flow control module 114.

When configured in a first position, the second auxiliary valve 320 may block fluid communication between the first port 302 of the first rotating group 300 and the port 316 of the flow control module 114 via the second auxiliary valve 320. When configured in a second position, the second auxiliary valve 320 may effect fluid communication between the first port 302 of the first rotating group 300 and the port 316 of the flow control module 114 via the flow passage 322.

The second auxiliary valve 320 may include a resilient element 324 that biases the configuration of the second auxiliary valve 320 toward the first position. The second auxiliary valve 320 may further include an actuator 326 that acts to bias the configuration of the second auxiliary valve 320 toward the second position, against the resilient element 324. Alternatively, the actuator 326 may be double-acting, and therefore capable of biasing the configuration of the second auxiliary valve 320 toward either its first position or its second position.

The actuator 326 may be a hydraulic actuator, a pneumatic actuator, a solenoid actuator, or any other type of actuator known to persons having skill in the art. The actuator 326 may cause the configuration of the second auxiliary valve 320 to toggle between its first position and its second position. Alternatively, actuator 326 may actuate the configuration of the second auxiliary valve 320 across a spectrum of throttle positions proportional to a control signal applied to the actuator 326. It will be appreciated that the actuator 326 may be operatively coupled to the controller 138 and may be actuated by control signals transmitted therefrom.

The first port 302 of the first rotating group 300 may also be in fluid communication with the accumulator system 112 via a conduit 328. The conduit 328 may be in series fluid communication with a third auxiliary valve 330, which may effect selective fluid communication between the first port 302 of the first rotating group 300 and the accumulator system 112.

When configured in a first position, the third auxiliary valve 330 may block fluid communication between the first port 302 of the first rotating group 300 and the accumulator system 112 via the third auxiliary valve 330. When configured in a second position, the third auxiliary valve 330 may effect fluid communication between the first port 302 of the first rotating group 300 and the accumulator system 112 via the flow passage 332.

The third auxiliary valve 330 may include a resilient element 334 that biases the configuration of the third auxiliary valve 330 toward the first position. The third auxiliary valve 330 may further include an actuator 336 that acts to bias the configuration of the third auxiliary valve 330 toward the second position, against the resilient element 334. Alternatively, the actuator 336 may be double-acting, and therefore capable of biasing the configuration of the third auxiliary valve 330 toward either its first position or its second position.

The actuator 336 may be a hydraulic actuator, a pneumatic actuator, a solenoid actuator, or any other type of actuator known to persons having skill in the art. The actuator 336 may cause the configuration of the third auxiliary valve 330 to toggle between its first position and its second position. Alternatively, actuator 336 may actuate the configuration of the third auxiliary valve 330 across a spectrum of throttle positions proportional to a control signal applied to the actuator 336. It will be appreciated that the actuator 336 may be operatively coupled to the controller 138 and may be actuated by control signals transmitted therefrom.

The first port 302 of the first rotating group 300 may also be in fluid communication with the reservoir 124 via a conduit 338. The conduit 338 may be in series fluid communication with a first bypass valve 340, which may effect selective fluid communication between the first port 302 of the first rotating group 300 and the reservoir 124.

When configured in a first position, the first bypass valve 340 may block fluid communication between the first port 302 of the first rotating group 300 and the reservoir 124 via the first bypass valve 340. When configured in a second position, the first bypass valve 340 may effect fluid communication between the first port 302 of the first rotating group 300 and the reservoir 124 via the flow passage 342.

The first bypass valve 340 may include a resilient element 344 that biases the configuration of the first bypass valve 340 toward the first position. The first bypass valve 340 may further include an actuator 346 that acts to bias the configuration of the first bypass valve 340 toward the second position, against the resilient element 344. Alternatively, the actuator 346 may be double-acting, and therefore capable of biasing the configuration of the first bypass valve 340 toward either its first position or its second position.

The actuator 346 may be a hydraulic actuator, a pneumatic actuator, a solenoid actuator, or any other type of actuator known to persons having skill in the art. The actuator 346 may cause the configuration of the first bypass valve 340 to toggle between its first position and its second position. Alternatively, actuator 346 may actuate the configuration of the first bypass valve 340 across a spectrum of throttle positions proportional to a control signal applied to the actuator 346. It will be appreciated that the actuator 346 may be operatively coupled to the controller 138 and may be actuated by control signals transmitted therefrom.

A check valve 356 may be disposed in series fluid communication between the first port 302 of the first rotating group 300 and the port 316 of the flow control module 114, the port 304 of the flow control module, the accumulator system 112, the reservoir 124, or combinations thereof. The check valve 356 may be configured to allow flow therethrough in a direction away from the first port 302 of the first rotating group 300, and block flow therethrough in a direction toward the first port 302 of the first rotating group 300.

A second port 348 of the first rotating group 300 may be in fluid communication with the reservoir 124 via the conduit 350, and the second port 348 of the first rotating group 300 may be in further fluid communication with the accumulator system 112 via a conduit 352 coupled to the conduit 350 at a node 354. A check valve 358 may be disposed in series fluid communication between the second port 348 of the first rotating group 300 and the return line node 129 along conduit 134 from port 136 of the flow control module 114. The check valve 358 may be configured to allow flow therethrough in a direction from the return line node 129 toward the second port 348 of the first rotating group 300, and block flow therethrough in a direction from the second port 348 of the first rotating group 300 toward the return line node 129.

The first rotating group 300 may be directly or indirectly coupled to the power source 18 via a shaft 360. Indirect coupling between the shaft 360 of the first rotating group 300 and the power source 18 may include a torque converter, a gear box, an electrical circuit, or other coupling method known in the art. Further, the first rotating group 300 may be coupled to the power source 18 in tandem (e.g., via the same shaft) or in parallel (e.g., via a gear train) with other rotating groups of the machine 10, as desired.

The first rotating group 300 may act as a pump to convert input shaft power into fluid power out of the first rotating group 300, or the first rotating group 300 may act as a motor to convert input fluid power into shaft power out of the first rotating group 300. Accordingly, the first rotating group 300 may operate in various modes corresponding to different states of shaft power and fluid power input and output. For example, the first rotating group 300 may receive shaft power via the shaft 360, receive fluid power via the second port 348, or combinations thereof. Further, the first rotating group 300 may output shaft power via the shaft 360, output fluid power via the first port 302, or combinations thereof. The first rotating group 300 may have variable displacement, which is controlled via the controller 138. The first rotating group 300 may include a stroke-adjusting mechanism, for example a swashplate, a position of which is hydro-mechanically adjusted based on, among other things, a desired speed of the actuators, to thereby vary an output (e.g., a discharge flow rate) of the first rotating group 300. Further, the displacement of the first rotating group 300 may be adjusted from a zero displacement position at which substantially no fluid is discharged from first rotating group 300, to a maximum displacement position in a first direction at which fluid is discharged from first rotating group 300 at a maximum rate through the first port 302 of the first rotating group 300.

The first rotating group 300 may also operate selectively as a motor. For example, when an actuator is operating in an overrunning condition (i.e., a condition where the actuator fluid discharge pressure is greater than the actuator fluid inlet pressure), the fluid discharged from the actuator may have a pressure elevated above an output pressure of the first rotating group 300. In this situation, the elevated pressure of the actuator fluid directed back through the first rotating group 300 may act to drive the first rotating group 300 to rotate without assistance from the power source 18. Under some circumstances, the first rotating group 300 may even be capable of imparting energy to the power source 18, thereby improving an efficiency and/or a capacity of the power source 18.

Referring still to FIG. 3C, the auxiliary pump/motor system 110 may further include a second rotating group 370 having a first port 372 in fluid communication with a port 374 of the flow control module 114 via a conduit 376.

The first port 372 of the second rotating group 370 may also be in fluid communication with the reservoir 124 via a conduit 378. The conduit 378 may be in series fluid communication with a second bypass valve 380, which may effect selective fluid communication between the first port 372 of the second rotating group 370 and the reservoir 124.

When configured in a first position, the second bypass valve 380 may block fluid communication between the first port 372 of the second rotating group 370 and the reservoir 124 via the second bypass valve 380. When configured in a second position, the second bypass valve 380 may effect fluid communication between the first port 372 of the second rotating group 370 and the reservoir 124 via the flow passage 382.

The second bypass valve 380 may include a resilient element 384 that biases the configuration of the second bypass valve 380 toward the first position. The second bypass valve 380 may further include an actuator 386 that acts to bias the configuration of the second bypass valve 380 toward the second position, against the resilient element 384. Alternatively, the actuator 386 may be double-acting, and therefore capable of biasing the configuration of the second bypass valve 380 toward either its first position or its second position.

The actuator 386 may be a hydraulic actuator, a pneumatic actuator, a solenoid actuator, or any other type of actuator known to persons having skill in the art. The actuator 386 may cause the configuration of the second bypass valve 380 to toggle between its first position and its second position. Alternatively, actuator 386 may actuate the configuration of the second bypass valve 380 across a spectrum of throttle positions proportional to a control signal applied to the actuator 386. It will be appreciated that the actuator 386 may be operatively coupled to the controller 138 and may be actuated by control signals transmitted therefrom.

A check valve 388 may be disposed in series fluid communication between the first port 372 of the second rotating group 370 and the port 374 of the flow control module 114, the reservoir 124, or combinations thereof. The check valve 388 may be configured to allow flow therethrough in a direction away from the first port 372 of the second rotating group 370, and block flow therethrough in a direction toward the first port 372 of the second rotating group 370.

A second port 390 of the second rotating group 370 may be in fluid communication with the return line node 129 via the conduit 391. The check valve 358 may be disposed in series fluid communication between the second port 390 of the second rotating group 370 and the return line node 129. The check valve 358 may be configured to allow flow therethrough in a direction from the return line node 129 toward the second port 390 of the second rotating group 370, and block flow therethrough in a direction from the second port 390 of the second rotating group 370 toward the return line node 129.

The second rotating group 370 may be directly or indirectly coupled to the power source 18 via a shaft 392. Indirect coupling between the shaft 392 of the second rotating group 370 and the power source 18 may include a torque converter, a gear box, an electrical circuit, or other coupling method known in the art. Further, the second rotating group 370 may be coupled to the power source 18 in tandem (e.g., via the same shaft) or in parallel (e.g., via a gear train) with other rotating groups of the machine 10, such as, for example, the first rotating group 300, as desired.

The second rotating group 370 may act as a pump to convert input shaft power into fluid power out of the second rotating group 370, or the second rotating group 370 may act as a motor to convert input fluid power into shaft power out of the second rotating group 370. Accordingly, the second rotating group 370 may operate in various modes corresponding to different states of shaft power and fluid power input and output. For example, the second rotating group 370 may receive shaft power via the shaft 392, receive fluid power via the second port 390, or combinations thereof. Further, the second rotating group 370 may output shaft power via the shaft 392, output fluid power via the first port 372, or combinations thereof.

The second rotating group 370 may have variable displacement, which is controlled via the controller 138. The second rotating group 370 may also include a stroke-adjusting mechanism, for example a swashplate, a position of which is hydro-mechanically adjusted based on, among other things, a desired speed of the actuators, to thereby vary an output (e.g., a discharge flow rate) of the second rotating group 370. Further, the displacement of the second rotating group 370 may be adjusted from a zero displacement position at which substantially no fluid is discharged from second rotating group 370, to a maximum displacement position in a first direction at which fluid is discharged from second rotating group 370 at a maximum rate through the first port 372 of the second rotating group 370.

The second rotating group 370 may also operate selectively as a motor. For example, when an actuator is operating in an overrunning condition (i.e., a condition where the actuator fluid discharge pressure is greater than the actuator fluid inlet pressure), the fluid discharged from the actuator may have a pressure elevated above an output pressure of the second rotating group 370. In this situation, the elevated pressure of the actuator fluid directed back through the second rotating group 370 may act to drive the second rotating group 370 to rotate without assistance from the power source 18. Under some circumstances, the second rotating group 370 may even be capable of imparting energy to the power source 18, thereby improving an efficiency and/or a capacity of the power source 18.

Referring to FIG. 3A, the head-end port 92 of the first actuator 102 may be in fluid communication with the accumulator system 112 (see FIG. 3B) via a conduit 400. A check valve 402 may be disposed in series fluid communication with the conduit 400 such that the check valve 402 allows flow therethrough in a direction from the first actuator 102 toward the accumulator system 112, and blocks flow therethrough in a direction from the accumulator system 112 toward the first actuator 102.

A valve 404 may be disposed in series fluid communication with the conduit 118. When configured in a first position, the valve 404 may effect fluid communication between the head-end port 92 of the first actuator 102 and the port 122 of the flow control module 114 via the flow passage 406. When configured in a second position, the valve 404 may block fluid communication between the head-end port 92 of the first actuator 102 and the port 122 of the flow control module 114 via the valve 404.

The valve 404 may include a resilient element 408 that biases the configuration of the valve 404 toward the first position. The valve 404 may further include an actuator 410 that acts to bias the configuration of the valve 404 toward the second position, against the resilient element 408. Alternatively, the actuator 410 may be double-acting, and therefore capable of biasing the configuration of the valve 404 toward either its first position or its second position.

The actuator 410 may be a hydraulic actuator, a pneumatic actuator, a solenoid actuator, or any other type of actuator known to persons having skill in the art. The actuator 410 may cause the configuration of the valve 404 to toggle between its first position and its second position. Alternatively, actuator 410 may actuate the configuration of the valve 404 across a spectrum of throttle positions proportional to a control signal applied to the actuator 410. It will be appreciated that the actuator 410 may be operatively coupled to the controller 138 and may be actuated by control signals transmitted therefrom.

The hydraulic system 100 may further include a first regeneration circuit 412 in fluid communication with the conduit 116 at the node 414 and in fluid communication with the conduit 118 at the node 416. The first regeneration circuit 412 may effect selective fluid communication between the head-end port 92 and the rod-end port 94 of the first actuator 102 when the first actuator 102 is operating in an overrun condition. The first regeneration circuit 412 may further effect selective fluid communication between one of the head-end port 92 and the rod-end port 94 of the first actuator 102 with the reservoir 124. The first regeneration circuit 412 may be operatively coupled to the controller 138 and may be actuated by signals transmitted therefrom.

The hydraulic system 100 may further include a second regeneration circuit 420 in fluid communication with the conduit 150 at the node 422 and in fluid communication with the conduit 148 at the node 424. The second regeneration circuit 420 may effect selective fluid communication between the first port 144 of the second actuator 104 and the second port 146 of the second actuator 104 when the second actuator 104 is operating in an overrun condition. The second regeneration circuit 420 may also effect selective fluid communication between the first port 170 of the third actuator 164 and the second port 172 of the third actuator 164 when the third actuator 164 is operating in an overrun condition. The second regeneration circuit 420 may be operatively coupled to the controller 138 and may be actuated by signals transmitted therefrom. The second regeneration circuit 420 may also be operated hydromechanically via a regeneration circuit including a combination of one or more relief valves and one or more check valves.

Referring still to FIG. 3A, the second actuator 104, the third actuator 164, or both, may be in fluid communication with the accumulator system 112 (see FIG. 3B) via a conduit 430 extending from the shuttle valve 432. The shuttle valve 432 permits fluid communication from whichever of the conduit 148 and the conduit 150 has the highest pressure, and the conduit 430. The hydraulic system 100 may further include a sequence valve 434 in series fluid communication with the conduit 430 to set an operating pressure of the flow from the shuttle valve 432 to the accumulator system 112. Alternatively, the hydraulic system 100 may not include a sequence valve 434. Further, a check valve 436 may be disposed in series fluid communication with the conduit 430 such that the check valve 436 allows flow therethrough in a direction from the shuttle valve 432 toward the accumulator system 112, and blocks flow therethrough in a direction from the accumulator system 112 toward the shuttle valve 432.

A valve 438 may be disposed in series fluid communication with the conduit 154. When configured in a first position, the valve 438 may effect fluid communication between the first diverter valve assembly 142 and the reservoir 124 via the flow passage 440. When configured in a second position, the valve 438 may block fluid communication between the first diverter valve assembly 142 and the reservoir 124 via the valve 438.

The valve 438 may include a resilient element 442 that biases the configuration of the valve 438 toward the first position. The valve 438 may further include an actuator 444 that acts to bias the configuration of the valve 438 toward the second position, against the resilient element 442. Alternatively, the actuator 444 may be double-acting, and therefore capable of biasing the configuration of the valve 438 toward either its first position or its second position.

The actuator 444 may be a hydraulic actuator, a pneumatic actuator, a solenoid actuator, or any other type of actuator known to persons having skill in the art. The actuator 444 may cause the configuration of the valve 438 to toggle between its first position and its second position. Alternatively, actuator 444 may actuate the configuration of the valve 438 across a spectrum of throttle positions proportional to a control signal applied to the actuator 444. It will be appreciated that the actuator 444 may be operatively coupled to the controller 138 and may be actuated by control signals transmitted therefrom.

Referring still to FIG. 3B, the accumulator system 112 includes a first accumulator 450 and may include a second accumulator 452. The first accumulator 450 is fluidly coupled to the hydraulic system 100 via a conduit 454.

A first charge valve 456 is disposed in series fluid communication with the conduit 454. When configured in a first position, the first charge valve 456 may block fluid communication between the first accumulator 450 and the hydraulic system 100 via the first charge valve 456. When configured in a second position, the first charge valve 456 may effect fluid communication between the first accumulator 450 and the hydraulic system 100 via the flow passage 458.

The first charge valve 456 may include a resilient element 460 that biases the configuration of the first charge valve 456 toward the first position. The first charge valve 456 may further include an actuator 462 that acts to bias the configuration of the first charge valve 456 toward the second position, against the resilient element 460. Alternatively, the actuator 462 may be double-acting, and therefore capable of biasing the configuration of the first charge valve 456 toward either its first position or its second position.

The actuator 462 may be a hydraulic actuator, a pneumatic actuator, a solenoid actuator, or any other type of actuator known to persons having skill in the art. The actuator 462 may cause the configuration of the first charge valve 456 to toggle between its first position and its second position. Alternatively, actuator 462 may actuate the configuration of the first charge valve 456 across a spectrum of throttle positions proportional to a control signal applied to the actuator 462. It will be appreciated that the actuator 462 may be operatively coupled to the controller 138 and may be actuated by control signals transmitted therefrom.

The first accumulator 450 may be fluidly coupled to the shuttle valve 432 via the conduit 430, which is coupled to the conduit 454 at the node 464. Further, the first accumulator 450 may also be coupled to the first actuator 102 via the conduit 400, the conduit 328, and a conduit 459 extending from node 466 of conduit 328 to the node 464. A check valve 470 may be disposed in series fluid communication with the conduit 459, such that the check valve 470 allows flow therethrough in a flow direction toward the node 464, and blocks flow therethrough in a flow direction away from the node 464.

The node 464 may also be in fluid communication with the auxiliary pump/motor system 110 via the conduit 352. A check valve 472 may be disposed in series fluid communication with the conduit 352, such that the check valve 472 allows flow therethrough in a direction away from the node 464, and blocks flow therethrough in a direction toward the node 464.

A discharge valve 480 may be disposed in series fluid communication with the conduit 352. When configured in a first position, the discharge valve 480 may block fluid communication between the first accumulator 450 and the auxiliary pump/motor system 110 via the discharge valve 480. When configured in a second position, the discharge valve 480 may effect fluid communication between the first accumulator 450 and the hydraulic system 100 via the flow passage 482.

The discharge valve 480 may include a resilient element 484 that biases the configuration of the discharge valve 480 toward the first position. The discharge valve 480 may further include an actuator 486 that acts to bias the configuration of the discharge valve 480 toward the second position, against the resilient element 484. Alternatively, the actuator 486 may be double-acting, and therefore capable of biasing the configuration of the discharge valve 480 toward either its first position or its second position.

The actuator 486 may be a hydraulic actuator, a pneumatic actuator, a solenoid actuator, or any other type of actuator known to persons having skill in the art. The actuator 486 may cause the configuration of the discharge valve 480 to toggle between its first position and its second position. Alternatively, actuator 486 may actuate the configuration of the discharge valve 480 across a spectrum of throttle positions proportional to a control signal applied to the actuator 486. It will be appreciated that the actuator 486 may be operatively coupled to the controller 138 and may be actuated by control signals transmitted therefrom.

The second accumulator 490 is fluidly coupled to the hydraulic system 100 via a conduit 492. A second charge valve 494 is disposed in series fluid communication with the conduit 492. When configured in a first position, the second charge valve 494 may block fluid communication between the second accumulator 490 and the hydraulic system 100 via the second charge valve 494. When configured in a second position, the second charge valve 494 may effect fluid communication between the second accumulator 490 and the hydraulic system 100 via the flow passage 496.

The second charge valve 494 may include a resilient element 498 that biases the configuration of the second charge valve 494 toward the first position. The second charge valve 494 may further include an actuator 500 that acts to bias the configuration of the second charge valve 494 toward the second position, against the resilient element 498. Alternatively, the actuator 500 may be double-acting, and therefore capable of biasing the configuration of the second charge valve 494 toward either its first position or its second position.

The actuator 500 may be a hydraulic actuator, a pneumatic actuator, a solenoid actuator, or any other type of actuator known to persons having skill in the art. The actuator 500 may cause the configuration of the second charge valve 494 to toggle between its first position and its second position. Alternatively, actuator 500 may actuate the configuration of the second charge valve 494 across a spectrum of throttle positions proportional to a control signal applied to the actuator 500. It will be appreciated that the actuator 500 may be operatively coupled to the controller 138 and may be actuated by control signals transmitted therefrom.

The second accumulator 490 may be fluidly coupled to the first actuator 102 via the conduit 400 coupled to the conduit 492 at a node 502. Further, the second accumulator 452 may be in fluid communication with the third auxiliary valve 330 via the conduit 328 coupled to the conduit 492 at the node 502. In addition, the second accumulator 452 may be in fluid communication with the auxiliary pump/motor system 110 via a conduit 504 that extends from a node 506 of the conduit 492 to a node 508 of the conduit 352. A check valve 510 may be in series fluid communication with the conduit 504, such that the check valve 510 allows flow therethrough in a direction toward the node 508, and blocks flow therethrough in a direction away from the node 508.

The first accumulator 450, the second accumulator 452, or both, may store hydraulic energy as a displacement of a resilient member included therein. The resilient member of either the first accumulator 450 or the second accumulator 452 may include a volume of a gas, a resilient bladder, a coil spring, a leaf spring, combinations thereof, or any other resilient member known in the art.

It will be appreciated that any of the check valves 356, 358, 388, 436, 470, 472, and 510 may be so called spring-check valves that include a resilient element, which effects a threshold pressure difference across the check valve to open the check valve. Alternatively, it will be appreciated that any of the check valves 356, 358, 388, 436, 470, 472, and 510 may have a substantially negligible spring rate, such that a pressure difference required to open the check valve is insignificant compared to a fluid pressure at an inlet port of the check valve.

A pressure transducer 520 may be fluidly coupled to the conduit 454 between the first charge valve 456 and the first accumulator 450 to monitor a pressure in the first accumulator 450. Further, a pressure transducer 522 may be fluidly coupled to the conduit 492 at or near the node 506 to monitor a pressure in the second accumulator 452. The pressure transducer 520, the pressure transducer 522, or both, may be operatively coupled to the controller 138, such that the controller 138 may receive a signal indicative of a pressure inside the first accumulator 450 or a pressure inside the second accumulator 452 therefrom.

Referring to FIGS. 3A and 3C, the flow control module 114 may effect fluid communication between any one of the ports 132, 158, 180, 190, 220, 250, 374, 304, and 316, or combinations thereof, and any one of the ports 120, 122, 268, 270, 276, and 278, or combinations thereof. Further, the flow control module 114 may effect fluid communication between any one of the ports 120, 122, 132, 158, 180, 190, 220, 250, 268, 270, 276, 278, 374, 304, and 316, or combinations thereof, and the reservoir 124 via the conduit 134. Accordingly, the flow control module 114 may effect open loop circuits to drive any one of the first actuator 102, the sixth actuator 260, the seventh actuator 262, or combinations thereof by supplying fluid power from any one of the first pump 106, the second pump 108, the third pump 166, the fourth pump 182, the fifth pump 202, the sixth pump 232, the first rotating group 300, the second rotating group 370, or combinations thereof, and discharging fluid exiting the actuators to the reservoir 124 via the port 136 of the flow control module 114.

Figure 5:
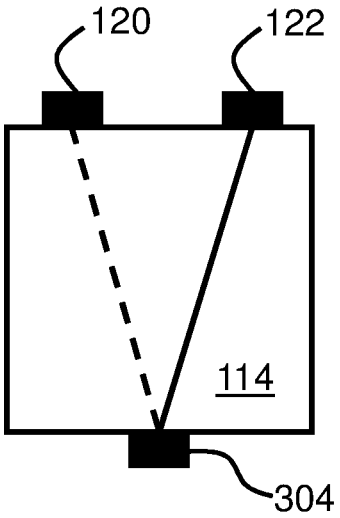
FIG. 5 shows a schematic view of a flow control module, according to an aspect of the disclosure.
Figure 6:
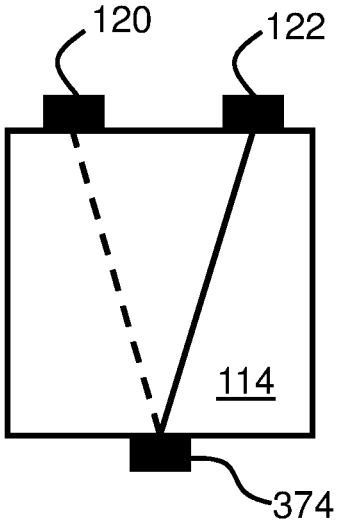
FIG. 6 shows a schematic view of a flow control module, according to an aspect of the disclosure.

As shown in FIG. 5, the flow control module 114 may effect fluid communication between the port 304 and the port 122, or alternatively effect fluid communication between the port 304 and the port 120. As shown in FIG. 6, the flow control module 114 may effect fluid communication between the port 374 and the port 122, or alternatively effect fluid communication between the port 374 and the port 120.

Further, the flow control module 114 may effect a bypass flow from any one of the first pump 106, the second pump 108, the third pump 166, the fourth pump 182, the fifth pump 202, the sixth pump 232, the first rotating group 300, the second rotating group 370, or combinations thereof, and direct the bypass flow to the reservoir 124 via the port 136 of the flow control module 114. According to an aspect of the disclosure, such bypass flows may be effected from one or more of the aforementioned pumps when the pump is rotating in a substantially idle mode with a small but finite displacement, such that the pump may respond quickly to a higher flow demand. The flow control module 114 may include fluid circuits with valves or other variable orifices, such as those in the Rexroth (Bosch Group) Type M8 compact valve blocks, for example, acting at least partly under the control of the controller 138. According to an aspect of the disclosure, the flow control module 114 includes one or more Rexroth Model Number M8-32 compact valve blocks, or the like, that are fluidly coupled to the hydraulic system 100 and operatively coupled to the controller 138. However, it will be appreciated that other control valve circuits could achieve the functions of the flow control module 114.

According to an aspect of the disclosure, a fluid path between the output of any one of the first pump 106, the second pump 108, the third pump 166, the fourth pump 182, the fifth pump 202, the sixth pump 232, the first rotating group 300, the second rotating group 370, or combinations thereof, and the flow control module 114 is free from any series fluid communication with another hydraulic pump or motor. According to another aspect of the disclosure, the hydraulic system 100 is free from fluid communication with any hydraulic pump coupled to a hydraulic motor via a shaft (e.g., a so called "hydraulic transformer"), where neither the hydraulic pump nor the hydraulic motor is further coupled to a shaft power source, such as the power source 18, for example.

INDUSTRIAL APPLICABILITY

The present disclosure may be applicable to any machine including a hydraulic system containing two or more hydraulic actuators. Aspects of the disclosed hydraulic system and method may promote operationally flexibility, performance, and energy efficiency of multi-actuator hydraulic systems.

According to an aspect of the disclosure, with reference to FIGS. 1 and 3, the machine 10 is a shovel or an excavator, and the first actuator 102 is a boom hydraulic cylinder 26, and the second actuator 104 and the third actuator 164 compose the hydraulic swing motor 48. In such a configuration the second actuator 104 may be a first swing actuator and the third actuator 164 may be a second swing actuator, or vice versa. During operation of machine 10, shown in FIG. 1, an operator located within station 20 may command a particular motion of the work tool 14 in a desired direction and at a desired velocity by way of the interface device 58.

One or more corresponding signals generated by the interface device 58 may be provided to the controller 138 (see FIG. 3) indicative of the desired motion, along with machine performance information, for example sensor data such as pressure data, position data, speed data, pump or motor displacement data, and other data known in the art. In response to the signals from interface device 58 and based on the machine performance information, controller 138 may generate control signals directed to the a stroke-adjusting mechanism of any of the first pump 106, the second pump 108, the third pump 166, the fourth pump 182, the fifth pump 202, the sixth pump 232, the first rotating group 300, the second rotating group 370, or combinations thereof (see FIG. 3) Further, the controller 138 may also generate control signals directed to actuation of the flow control module 114, any valve, any regeneration circuit, any diverter valve assembly, or other feature of the hydraulic system 100 that is capable of actuation.

The controller 138 may further include functionality for estimating the power demand for hydraulic actuators at points in time through a duty cycle. Then based on a comparison of estimated actuator power demand to the rated capacities of available pumps, the controller 138 may configure the flow control module 114 to advantageously allocate hydraulic pump outputs to the individual hydraulic actuators to promote system performance and energy efficiency throughout the duty cycle.

It will be appreciated that the controller 138 may be included in a single housing, or distributed throughout the hydraulic system 100 in more than one housing. Control signals from the controller 138 may take the form of pneumatic signals, hydraulic signals, electrical signals, wireless electromagnetic signals, combinations thereof, or any other control signal known in the art. It will be further appreciated that the controller 138 may be operatively coupled to the hydraulic system 100 via mechanical linkages, such that the controller 138 may sense positions of mechanical linkages and/or the controller 138 may actuate elements of the hydraulic system 100 by controlling positions of mechanical linkages.

When performing work against a load, the first actuator 102 may receive fluid power from the flow control module 114 via either the conduit 116 or the conduit 118, depending upon the desired direction of actuation. According to an aspect of the disclosure, supplying fluid to the head-end chamber 88 of the first actuator 102 raises the boom 22 of machine 10 against the direction of gravity, and supplying fluid to the rod-end chamber 82 of the first actuator 102 lowers the boom 22 along the direction of gravity.

During an overrun condition, where gravity performs work on the boom 22 to lower its position, the pressure in the head-end chamber 88 of the first actuator 102 may be greater than the pressure in the rod-end chamber 82 of the first actuator 102, even though fluid is exiting the head-end chamber 88 and entering the rod-end chamber 82. During such an overrun condition, the first regeneration circuit 412 may supply at least part of the fluid to the rod-end chamber 82 of the first actuator 102 from the head-end chamber 88 of the first actuator 102 instead of from the flow control module 114. The controller 138 may be configured to receive pressure signals from a head-end pressure transducer 512 and a rod-end pressure transducer 514, as shown in FIG. 3, to determine whether the first actuator 102 is operating in an overrun condition.

Further, according to FIG. 3, energy imparted to the fluid within the head-end chamber 88 of the first actuator 102 during an overrun condition may be stored in the accumulator system 112. The energy storage may be accomplished by actuating the valve 404 to block fluid communication between the head-end port 92 and the flow control module 114 and by opening the first charge valve 456, the second charge valve 494, or both. In turn, fluid energy from the head-end chamber 88 of the first actuator 102 may be stored in the first accumulator 450, the second accumulator 452, or both, in the form of pressurized fluid. At the end of the boom hydraulic cylinder 26 overrun condition, the first charge valve 456, the second charge valve 494, or both may be closed to isolate the fluid energy stored in the first accumulator 450 and the second accumulator 452 from the rest of the hydraulic system 100, including the auxiliary pump/motor system 110.

When accelerating a mass of the machine 10, and perhaps a load, about the swing axis 46, the second actuator 104 or the third actuator 164 may receive fluid power from the second pump 108 or the third pump 166, respectively. Conversely, when decelerating the mass of the machine 10, and perhaps a load, about the swing axis 46, an overrun condition may result for the second actuator 104 or the third actuator 164 as kinetic energy from the mass performs work on fluid exiting the second actuator 104 or the third actuator 164.

During an overrun condition of the hydraulic swing motor 48, where kinetic energy is converted into fluid energy exiting the hydraulic swing motor 48, the pressure of fluid exiting the second actuator 104 or the third actuator 164 may be greater than the pressure of fluid entering the same actuator. During such an overrun condition, the second regeneration circuit 420 may effect fluid communication between the first port 144 and the second port 146 of the second actuator 104, or effect fluid communication between the first port 170 and the second port 172 of the third actuator 164. The controller 138 may be configured to receive pressure signals from a pressure transducer 516 and a pressure transducer 518, as shown in FIG. 3, to determine whether the second actuator 104 or the third actuator 164 is operating in an overrun condition and effect appropriate control action in response.

Further, according to FIG. 3, energy imparted to the fluid exiting the second actuator 104 during an overrun condition may be stored in the accumulator system 112. The energy storage may be accomplished by actuating the valve 438 to block fluid communication between the first diverter valve assembly 142 and the reservoir 124, and by opening the first charge valve 456. In turn, fluid energy from the shuttle valve 432 may be stored in the first accumulator 450, in the form of pressurized fluid. According to an aspect of the disclosure, the conduit 430 may be in fluid communication with the first accumulator 450 but blocked from fluid communication with the second accumulator 452.

At the end of the swing axis 46 deceleration, the first charge valve 456 may be closed to isolate the fluid energy stored in the first accumulator 450 and the second accumulator 452 from the rest of the hydraulic system 100. It will be appreciated that the first actuator 102 and the second actuator 104 may both simultaneously experience an overrun condition, and that both may simultaneously store fluid energy in the accumulator system 112.

The sum of power demand from all components of the machine 10 at a moment in time may be less than a desired target capacity of the power source 18. In turn, excess power capacity of the power source 18 may then be stored in the accumulator system 112 by opening the third auxiliary valve 330, otherwise known as a peak-shaving valve, and opening the first charge valve 456 or the second charge valve 494. Accordingly, fluid power generated by the first rotating group 300 may be stored in the first accumulator 450, the second accumulator 452, or both.

Conversely, the sum of power demand from all components of the machine 10 at a moment in time may be greater than a desired target capacity of the power source 18. In response, fluid power stored in the accumulator system 112 may be applied to the hydraulic system 100 to supplement the power source 18 by opening the discharge valve 480, and optionally opening the first charge valve 456, thereby applying the stored fluid energy from the accumulator system 112 to the auxiliary pump/motor system 110 via the conduit 352.

Fluid power discharged from the accumulator system 112 may be applied to the second port 348 of the first rotating group 300 to supplement shaft power received through the shaft 360, or replace a portion of shaft power received through the shaft 360 to produce a desired fluid power output at the first port 302 of the first rotating group 300. Further, a portion of fluid power discharged from the accumulator system 112 and applied to the second port 348 of the first rotating group 300 may be converted into shaft power out of the shaft 360, with the balance of incoming fluid power being output from the first port 302 of the first rotating group 300, minus any losses through the first rotating group 300. According to an aspect of the disclosure, the first rotating group 300 is operated as a motor that converts fluid power received from the second port 348 into shaft power out of the shaft 360, and resulting in small or negligible fluid power output from the first port 302, which is directed to the reservoir 124 via the first bypass valve 340 and conduit 338.

Likewise, the fluid power discharged from the accumulator system 112 may be applied to the second port 390 of the second rotating group 370 to supplement shaft power received through the shaft 392, or replace a portion of shaft power received through the shaft 392 to produce a desired fluid power output at the first port 372 of the second rotating group 370. Further, a portion of fluid power discharged from the accumulator system 112 and applied to the second port 390 of the second rotating group 370 may be converted into shaft power out of the shaft 392, with the balance of incoming fluid power being output from the first port 372 of the second rotating group 370, minus any losses through the second rotating group 370. According to an aspect of the disclosure, the second rotating group 370 is operated as a motor that converts fluid power received from the second port 390 into shaft power out of the shaft 392, and resulting in small or negligible fluid power output from the first port 372, which is directed to the reservoir 124 via the second bypass valve 380 and the conduit 378.

In addition, it will be appreciated that the first rotating group 300, the second rotating group 370, or both, may receive fluid power directly from the first actuator 102 during an overrun condition, receive fluid power directly from the second actuator 104 and/or the third actuator 164 during an overrun condition, or both, via the discharge valve 480 and the conduit 352. Thus, overrun fluid power from the first actuator 102, the second actuator 104, or the third actuator 164 may be stored in the accumulator system 112 before delivery to the auxiliary pump/motor system 110, or may be delivered directly to the auxiliary pump/motor system 110.

As discussed previously, the pumping action of the first rotating group 300 may supply hydraulic fluid to port 304 of the flow control module 114, port 316 of the flow control module 114, or both, by operation of the first auxiliary valve 308 and the second auxiliary valve 320. If fluid power applied to the second port 348 of the first rotating group 300 via the discharge valve 480 exceeds the demand for fluid power at the port 304 and the port 316 of the flow control module, then the excess fluid power from the discharge valve 480 could be converted into shaft power through the first rotating group 300, with the fluid discharged from the first port 302 of the first rotating group 300 being directed to the port 304 of the flow control module 114 via the first auxiliary valve 308, the port 316 of the flow control module 114 via the second auxiliary valve 320, the reservoir 124 via the first bypass valve 340, or combinations thereof.

Similarly, if fluid power applied to the second port 390 of the second rotating group 370 via the discharge valve 480 exceeds the demand for fluid power at the port 374 of the flow control module 114, then the excess fluid power from the discharge valve 480 could be converted into shaft power through the second rotating group 370, with the fluid discharged from the first port 372 of the second rotating group 370 being directed to the port 374 of the flow control module 114, the reservoir 124 via the second bypass valve 380, or combinations thereof.

According to an aspect of the disclosure, the auxiliary pump/motor system 110, the accumulator system 112, or both, are included in a kit to be added to a machine 10. Further, such a kit may also include corresponding control structures or software that compose, at least in part, the controller 138. According to another aspect of the disclosure, a kit including the auxiliary pump/motor system 110, the accumulator system 112, corresponding control elements 138, or combinations thereof, are installed on a machine 10.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Throughout the disclosure, like reference numbers refer to similar elements herein, unless otherwise specified.

We claim:

1. A hydraulic system, comprising:

a flow control module;

a first pump fluidly coupled to the flow control module via a first conduit;

a first rotating group fluidly coupled to the flow control module via a second conduit and a fifth conduit, the first rotating group being configured to perform a pumping function and a motor function;

a first actuator fluidly coupled to the flow control module;

a second actuator fluidly coupled to a second pump;

a first accumulator being in selective fluid communication with the first actuator via a third conduit and a first charge valve, the second actuator via a fourth conduit and the first charge valve, and the first rotating group via a discharge valve; and a controller operatively coupled to the flow control module, the first charge valve, and the discharge valve, the controller being configured to selectively effect fluid communication between the first actuator and the first pump via the first conduit, selectively effect fluid communication between the first actuator and the first rotating group via the second conduit, selectively effect fluid communication between the first actuator and the first rotating group via the fifth conduit, selectively charge the first accumulator by operating the first charge valve, and selectively discharge the first accumulator through the first rotating group by operating the discharge valve.

2. The hydraulic system of claim 1, further comprising an auxiliary valve in series fluid communication with the second conduit, the auxiliary valve being operatively coupled to the controller, and the controller being further configured to effect selective fluid communication between the first rotating group and the flow control module via the second conduit by operating the auxiliary valve.

3. The hydraulic system of claim 1, further comprising a first auxiliary valve in series fluid communication with the second conduit; and a second auxiliary valve in series fluid communication with the fifth conduit, the first auxiliary valve and the second auxiliary valve being operatively coupled to the controller, and the controller being further configured to effect selective fluid communication between the first rotating group and the flow control module via the second conduit by operating the first auxiliary valve, and effect selective fluid communication between the first rotating group and the flow control module via the fifth conduit by operating the second auxiliary valve.

4. The hydraulic system of claim 1, wherein the first rotating group is further fluidly coupled to the first accumulator via a sixth conduit, the hydraulic system further includes a peak-shaving valve in series fluid communication with the sixth conduit, the peak-shaving valve is operatively coupled to the controller, and the controller is further configured to selectively charge the first accumulator by operating the peak-shaving valve.

5. The hydraulic system of claim 1, further comprising a second accumulator, the second accumulator being in selective fluid communication with the first actuator via the third conduit and a second charge valve.

6. The hydraulic system of claim 5, wherein the second accumulator is further in selective fluid communication with the first rotating group via the second charge valve and the discharge valve.

7. The hydraulic system of claim 5, wherein the second accumulator is further in selective fluid communication with the first rotating group via the second charge valve and a peak-shaving valve.

8. The hydraulic system of claim 1, wherein a first port of the first rotating group is fluidly coupled to a reservoir via a seventh conduit, a second port of the first rotating group is fluidly coupled to the reservoir via a sixth conduit and a bypass valve in series fluid communication with the sixth conduit, the bypass valve is operatively coupled to the controller, and the controller is further configured to selectively effect fluid communication between the second port of the first rotating group and the reservoir via the sixth conduit by operating the bypass valve.

9. The hydraulic system of claim 1, further comprising a second rotating group fluidly coupled to the flow control module via a sixth conduit, the second rotating group being configured to perform the pumping function and the motor function, the controller being further configured to selectively effect fluid communication between the second rotating group and the first actuator via the sixth conduit.

10. The hydraulic system of claim 9, wherein the first accumulator is in further fluid communication with the second rotating group via the discharge valve.

11. The hydraulic system of claim 10, wherein a first port of the second rotating group is fluidly coupled to a reservoir via a seventh conduit, a second port of the second rotating group is fluidly coupled to the reservoir via an eighth conduit and a bypass valve in series fluid communication with the eighth conduit, the bypass valve is operatively coupled to the controller, and the controller is further configured to selectively effect fluid communication between the second port of the second rotating group and the reservoir via the eighth conduit by operating the bypass valve.

12. A machine comprising the hydraulic system of claim 1, wherein the machine is one of a shovel and an excavator, the first actuator is a boom actuator, and the second actuator is a swing actuator.

13. A method for operating a hydraulic system, the hydraulic system including a flow control module, a first pump fluidly coupled to the flow control module via a first conduit, a first rotating group fluidly coupled to the flow control module via a second conduit, the first rotating group being configured to perform a pumping function and a motor function, a first actuator fluidly coupled to the flow control module, a second actuator fluidly coupled to a second pump, a first accumulator being in selective fluid communication with the first actuator via a third conduit and a first charge valve, the second actuator via a fourth conduit and the first charge valve, and the first rotating group via a fifth conduit and a peak-shaving valve in series fluid communication with the fifth conduit, and via a discharge valve, the method comprising:

effecting selective fluid communication between the first actuator and the first pump via the first conduit;

effecting selective fluid communication between the first actuator and the first rotating group via the second conduit;

charging the first accumulator by operating the first charge valve;

charging the first accumulator by operating the peak-shaving valve; and discharging the first accumulator through the first rotating group by operating the discharge valve.

14. The method according to claim 13, wherein a first port of the first rotating group is fluidly coupled to a reservoir via a seventh conduit, and a second port of the first rotating group is fluidly coupled to the reservoir via a sixth conduit and a bypass valve in series fluid communication with the sixth conduit, the method further comprising effecting selective fluid communication between the second port of the first rotating group and the reservoir via the sixth conduit by operating the bypass valve.

15. The method according to claim 13, wherein the hydraulic system further includes a second rotating group fluidly coupled to the flow control module via a sixth conduit, the second rotating group being configured to perform the pumping function and the motor function, the method further comprising effecting selective fluid communication between the second rotating group and the first actuator via the first conduit and the sixth conduit.

16. The method according to claim 13, wherein the first actuator is a boom actuator, and the charging the first accumulator further includes converting a boom potential energy into a fluid energy stored in the first accumulator.

17. The method according to claim 13, wherein the second actuator is a swing actuator, and the charging the first accumulator further includes converting a swing kinetic energy into a fluid energy stored in the first accumulator.

* * * * *